US006902267B2

(12) United States Patent
Ohya et al.

(10) Patent No.: US 6,902,267 B2
(45) Date of Patent: Jun. 7, 2005

(54) INK-JET IMAGE FORMING METHOD

(75) Inventors: Hidenobu Ohya, Hachioji (JP); Shuji Kida, Iruma (JP); Shinichi Suzuki, Saitama (JP); Keiichiro Suzuki, Hachioji (JP); Makoto Kaga, Hachioji (JP); Teruyuki Fukuda, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

(21) Appl. No.: 10/701,255

(22) Filed: Nov. 3, 2003

(65) Prior Publication Data

US 2004/0090513 A1 May 13, 2004

(30) Foreign Application Priority Data

Nov. 13, 2002 (JP) ..... 2002-329507

(51) Int. Cl.[7] ..... B41J 2/01
(52) U.S. Cl. ..... 347/104; 347/106; 101/416.1
(58) Field of Search ..... 347/101, 104, 347/105, 106; 101/416.1

(56) References Cited

U.S. PATENT DOCUMENTS 4,832,984 A * 5/1989 Hasegawa et al. ..... 427/161
5,053,382 A * 10/1991 Akada et al. ..... 503/227
5,146,087 A * 9/1992 VanDusen ..... 399/2
5,455,604 A * 10/1995 Adams et al. ..... 346/138
6,357,871 B1 * 3/2002 Ashida et al. ..... 347/106
2002/0027587 A1 * 3/2002 Sugaya et al. ..... 347/104
2003/0160850 A1 * 8/2003 Ohya et al. ..... 347/101

FOREIGN PATENT DOCUMENTS

JP 56077154 A * 6/1981
JP 01085768 A * 3/1989
JP 11105271 A * 11/1999

* cited by examiner

*Primary Examiner*—Andrew H. Hirshfeld
*Assistant Examiner*—Jill E. Culler
(74) *Attorney, Agent, or Firm*—Squire, Sanders & Dempsey L.L.P.

(57) ABSTRACT

A method of forming an ink-jet image, comprising the steps of: ejecting droplets of an ink onto an ink-jet recording media which includes a support having thereon an outermost layer containing a thermoplastic resin; and then applying pressure onto the outermost layer with a pressing apparatus so that a thickness of the outermost layer after applying pressure is 50 to 80% of the outermost layer before being applied pressure.

11 Claims, 1 Drawing Sheet

INK-JET IMAGE FORMING METHOD

TECHNICAL FIELD

The present invention relates to an ink-jet image forming method.

BACKGROUND

In recent years, the progress of ink-jet technology has been remarkable, and as a result, ink-jet image quality has been called photographic image quality due to enhancement of printer technology, ink technology and specific recording medium technology. In accordance with enhancement of image quality, ink-jet image storage stability has been favorably compared to conventional photography. In many cases of dye ink, pointed out as drawbacks are deterioration of ink-jet images accompanied with transfer of coloring materials as well as poor water resistance and poor anti-bleeding property, in addition to deterioration accompanied with chemical reactions specific to coloring materials such as light stability and oxidizing gas resistance.

On the other hand, to improve storage stability of dye ink images, usage of pigment ink has been proposed by many knowledgeable in the art. However, in the case of pigment ink, it may not be preferable due to the possibility of not achieving enough glossiness as with silver halide photography, or exhibiting metallic luster known as bronzing. Further, in the present situation, sufficient image storage stability cannot be achieved by only employing pigment ink.

Recognizing the foregoing problems, to enhance image storage stability of ink-jet recording images, many proposals have been disclosed. For example, as an ink-jet recording medium, an accomplishment is described in Japanese Patent Application Publication Nos. 59-22238 1, 4-21446, 10-315448, 11-5362 and 11-192775 (hereinafter, referred to as JP-A Nos.) to improve water resistance and weather resistance and to provide image glossiness during formation of a high polymer protective coating, which is prepared with a layer comprising thermoplastic organic polymer particles provided that the outermost layer of the recording medium, and the thermoplastic organic polymer particles are melted to form a film layer after image recording.

However, in the technologies described in the foregoing official publications, there are some insufficient points in some characteristic criteria. Firstly, scratch resistance is insufficient. The images described in the above publications exhibit preferable image quality, due to enhanced glossiness with formation of a resin layer, but on the other hand, the surface is easily scratched and the scratches tend to be highly visible, which calls for improvement. Secondly, print cracking resistance is also not adequate. Specifically, the problem is that images suffer cracking in portion or the total area in cases when images are stored for relatively long periods or are exposed to high temperature and humidity conditions. Thirdly, scratch resistance under high humidity is insufficient. This is a phenomenon in which images or layers can be easily peeled off by simple finger rubbing when wet. For example, when images wetted by spilled water or coffee, or by rain when viewed outdoors, the images or the layers may be peeled off when wiped. When images are printed with pigment ink, which printing recently has spread rapidly, these problems are more serious. In addition, when printed with pigment ink, pigment does not permeate, or only slightly permeates into the deeper portions of the recording medium as is the case with dye ink. Accordingly, expression of glossiness may be insufficient, or the bronzing phenomenon may result. It is desired to overcome these problems.

On the other hand, a method of a pressurizing treatment of a layer containing thermoplastic organic polymer particles after image recording is proposed (for example, in Patent Document 1). However, considering the results of the Examples, there is no layer thickness change between before and after the pressurizing treatment, and thus, the need for compressing the layer thickness cannot be specifically identified.

Further, a method to make a layer non-porous by a heating process, in which a layer comprising a thermoplastic resin at a void ratio of 15–40% is proposed (for example, in Patent Document 2). However, in this method, only a heating process is mentioned, not compression of the layer thickness by providing a pressurizing treatment. And the degree of compressing the surface layer is not described at all.

Further, methods to add a specific amount of an inorganic pigment to a thermoplastic resin containing layer are described (for example, in Patent Documents 3–5). However, not described in any of these methods, is compression of the layer thickness with a pressurizing treatment nor the degree of the surface layer compression.

Patent Document 1: JP-A 7-237348

Patent Document 2: JP-A 11-5362 (claims)

Patent Document 3: JP-A 2002-234256 (claims)

Patent Document 4: JP-A 2002-234246 (claims)

Patent Document 5: JP-A 2002-234248 (claims)

SUMMARY

From the viewpoint of the foregoing, the present invention is being offered. The first object of the present invention is to provide an ink-jet image forming method of improved scratch resistance of printed images. The second object of the invention is to provide an ink-jet image forming method of reduced image cracking during storage. The third object of the invention is to provide an ink-jet image forming method of improved print crack resistance under high humidity. The fourth object of the invention is to provide formation of ink-jet images of high density and high gloss. The fifth object of the invention is to provide ink-jet images of inconspicuous bronzing even when printed with pigment ink.

The foregoing objects of the present invention were achieved employing the following embodiments.

(1) A method of forming an ink-jet image, comprising the steps of:

ejecting droplets of an ink onto an ink-jet recording media which includes a support having thereon an outermost layer containing a thermoplastic resin; and then applying pressure onto the outermost layer with a pressing apparatus so that a thickness of the outermost layer after applying pressure is 50 to 80% of the outermost layer before applying pressure.

(2) The method of forming an ink-jet image of item 1, wherein the outermost layer further contains a filler.

(3) The method of forming an ink-jet image of item 2, wherein a weight ratio of the thermoplastic resin to the filler is 2:8 to 8:2.

(4) The method of forming an ink-jet image of item 1, wherein the ink-jet recording media further contains an ink absorbing layer between the outermost layer and the support, and a mean void ratio in a combined section of the ink absorbing layer and the outermost layer is from 40 to 70% based on the total volume of the combined section.

(5) The method of forming an ink-jet image of item 1 or item 4, wherein the outermost layer is a porous ink receiving layer having a mean void ratio of 30 to 70% based on the total volume of the outermost layer.

(6) The method of forming an ink-jet image of item 1, wherein the outermost layer has a thickness of 3 to 15 $\mu$m.

(7) The method of forming an ink-jet image of item 1, wherein the support is non-water absorptive.

(8) The method of forming an ink-jet image of item 1, wherein the applied pressure is 0.5 to 10 MPa.

(9) The method of forming an ink-jet image of item 1, wherein the pressing apparatus has a pressing member which contacts the outermost layer of the ink-jet recording media, and the pressing member has a surface roughness of not more than 200 nm.

(10) The method of forming an ink-jet image of item 1, further comprising the step of:

applying heat onto the ink-jet recording media prior to the pressure applying step or during the pressure applying step.

(11) The method of forming an ink-jet image of item 1, wherein the ink contains a pigment.

DESCRIPTION OF THE PREFERRED EMBODIMENTS

The details of the present invention will now be described below.

Figure 1:
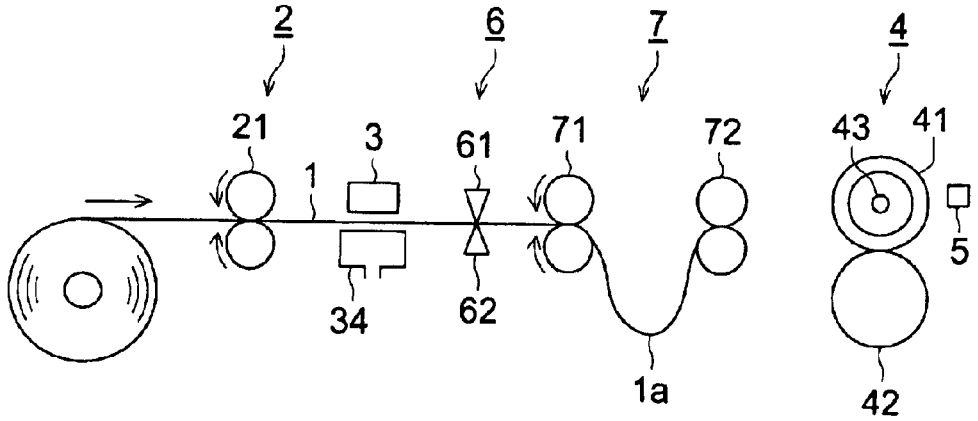
FIG. 1 is a schematic view showing an example of an ink-jet recording apparatus used in the present invention.
Figure 2:
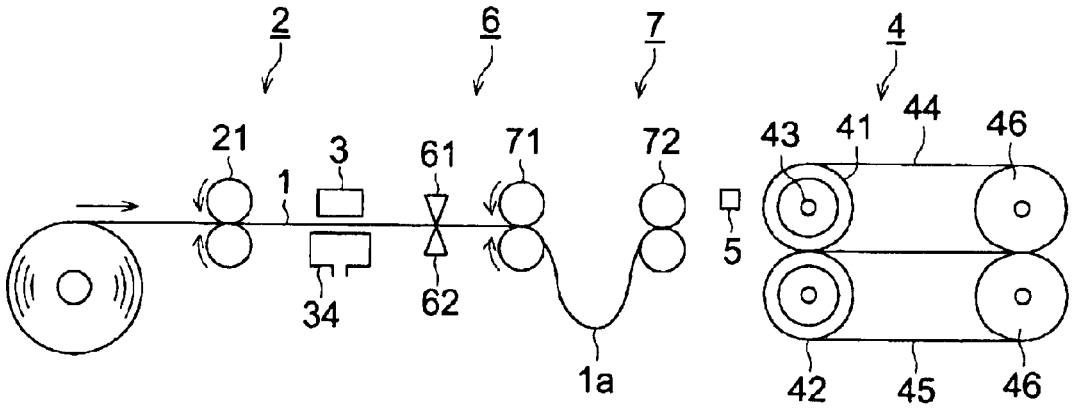
FIG. 2 is another schematic view showing an example of an ink-jet recording apparatus used in the present invention.

Explanation of FIG. 1 and FIG. 2

FIG. 1 is a schematic view showing one example of the structure of an ink-jet recording apparatus employed in the present invention. In FIG. 1, recording material 1 fed, from paired transport rollers 21 is subjected to ink-jet recording at printing stage 34, employing printing head 3 and is then cut to a desired size, employing cutter 61 and cutter 62. The resultant cut material is conveyed to first paired rollers 71 and then to second paired rollers 72 in a suspended state 1*a*.

Number 2 indicates a transport means, number 5 indicates a thermal sensor, number 6 indicates a cutting means and number 7 indicates a suspended state forming means.

Subsequently, said material is conveyed to thermal fixing means 4 and passed and then passed between heating roller 41, comprising heating body 43 in its interior, and pressure roller 42.

FIG. 2 is a schematic view showing another example of the structure of the ink-jet recording apparatus employed in the present invention. In FIG. 2, recording material 1 fed from paired transport rollers 21 is subjected to ink-jet recording at printing stage 34, employing printing head 3 and is then cut to a desired size, employing cutter 61 and cutter 62. The resultant cut material is conveyed to first paired rollers 71 and then to second paired rollers 72 in a suspended state 1*a*. Number 2 indicates a transport means, number 5 indicates a thermal sensor, number 6 indicates a cutting means and number 7 indicates a suspended state forming means.

Subsequently, said material is conveyed to thermal fixing means 4, and then passed between heating roller 41, comprising heating body 43 in its interior, and pressure roller 42 together with fixing belt 44, second fixing belt 45 and driven roller 46, whereby a thermal fixing treatment is carried out.

As a result of diligent investigation in view of the above-mentioned situations, the inventors of the present invention have solved the foregoing problems to control the degree of compression for thickness of a thermoplastic resin containing layer, by controlling various characteristics of the ink-jet recording medium (hereinafter, referred to simply as a recording medium), and conditions of a pressurizing process which is provided after printing.

The ink-jet image forming method of this invention is characterized by the steps of:

1) printing with ink-jet onto an ink-jet recording medium having a surface layer containing a thermoplastic resin;

2) providing a pressurizing treatment to the ink-jet recording medium in a post-process incorporating a pressurizing process; and 3) compressing the thickness of the surface layer during the post-process to 50–80% of its original thickness.

When the compression is 85 to 100% (no compression), scratching resistance under normal or high humidity conditions and cracking resistance under high humidity conditions are smaller. These properties may damage the image quality.

When the compression is large enough to achieve 45% or less, it may generate waviness undulations, lower the glossiness or produce cracking. Therefore, the compression to achieve 50–80% of its original thickness is preferred.

In this invention, the surface layer containing a thermoplastic resin preferably has an appropriate void ratio to effectively absorb ink during ink-jet recording and to enable adequate pressurizing in a post-pressurizing process. The reason that the thickness of the surface layer containing a thermoplastic resin can be compressed in this invention is based on the fact that a portion or the total void area can be compressed. With compression of the void area in the range of 50–80%, surface uniformity and smoothness are greatly enhanced, and also slippage property is increased, resulting in the advantage to allow a force to escape from generation of scratch at surface. It is assumed that scratch resistance is enhanced as a result. Further, it is also assumed that by compression of the void area beyond a specified level as mentioned above, water and moisture tend to barely permeate, resulting in enhancement of scratch resistance under high humidity, and also resulting in reduced image cracking after long storage, specifically under conditions of high temperature and high humidity. However, excessive compression, so that the thickness is compressed more than 50%, may cause excessive stress on the recording medium to generate waviness undulations, or a roughened surface, resulting in lowered glossiness. Therefore, excessive compression is to be avoided.

The compression of the void area to achieve the ratio 70–80% based on the initial volume is more preferred. By achieving the ratio 70–80%, the scratch resistance under normal humidity and under high humidity is enhanced and image cracking after long storage, specifically under conditions of high temperature and high humidity, is reduced.

Further, in the ink-jet image forming method of this invention, the surface layer containing a thermoplastic resin preferably further contains a filler, a so-called inorganic pigment, and further, it is preferable that the ratio (B:F) of a thermoplastic resin (B) and a filler (F) is 2:8–8:2.

By containing a filler in the surface layer containing a thermoplastic resin, large beneficial effects may be achieved to prevent color bleeding and beading which are common factors of image quality deterioration. In addition, releasability between the pressurizing apparatus and the recording medium surface during compression of the surface layer may be enhanced. Further, containing a filler in the surface layer containing a thermoplastic resin is preferable from the viewpoint of scratch resistance, scratch resistance under high humidity; and image cracking resistance after long term storage, specifically under conditions of high temperature and high humidity. It is assumed that these desirable effects are the result of increased film strength which is obtained by mixing a filler in the surface layer containing a thermoplastic resin.

Further, in the ink-jet image forming method of this invention, the average void ratio of the total ink absorbing layer (including the surface layer) of the ink-jet recording medium is preferably 40–70%.

The surface layer containing a thermoplastic resin in this invention, as mentioned above, is necessary to have the appropriate void ratio to effectively absorb ejected ink and to allow adequate pressurization in the post-process. Specifically, to achieve an average void ratio of the total ink absorbing layer to more than 40%, generation of color bleeding and beading may be effectively prevented, which may be one of the factors leading to deteriorated image quality. Further, it is also a preferable embodiment to compress the surface layer, which characterizes this invention. However, in cases when the average void ratio of the total ink absorbing layer exceeds 70%, it tends to promote failures (such as cracking) specifically during the coating or drying process in recording medium production, which is not preferable due to lowered productivity. Further, the average void ratio of more than 70% is also not preferable because it may cause folding and cracking. Additionally, by setting the average void ratio of the total ink absorbing layer in the above range, generation of image cracking during long term storage, specifically under conditions of high temperature and high humidity, may be prevented.

Further, in the ink-jet image forming method of this invention, the surface layer void ratio of the ink-jet recording medium is preferably 30–70%. When this range is maintained, each of the effects obtained at a 40–70% average void ratio of the above total ink-jet ink absorbing layer can be maximized much more effectively.

Further, in the ink-jet image forming method of this invention, the surface layer thickness is preferably 3–15 $\mu$m.

To accomplish the objects of this invention, to form a surface layer which satisfactorily exhibits the desired effects, and further to obtain the preferable glossiness, the surface layer thickness is preferably more than 3 $\mu$m. However, when the surface layer thickness exceeds 15 $\mu$m, not only excessive time and energy for compression must be spent during the pressurizing process as a post-process, but also only partial compression shortage may result, causing image defects. Further, ink absorbability may be affected, and as a result, color bleeding or beading may be caused, resulting in undesirable image quality deterioration.

Further, in the ink-jet image forming method of this invention the ink-jet recording medium is preferably coated onto a non-water permeable support (or non-water absorptive support).

With the ink-jet image forming method of this invention, photographic-like images exhibiting high quality, high gloss and superior image stability and surface properties can be obtained, and to that end, specifically preferred is coating the ink absorbing layer onto a non-water permeable support having excellent smoothness and uniformity. Further, by employing the non-water permeable support which is barely affected by effects of moisture and vapor from the reverse side, the preferable surface layer is formed, which maintains its desirable characteristics for a long period.

Furthermore, in the ink-jet image forming method of this invention, the pressurizing conditions during the pressurizing process after printing employing an ink-jet method are preferably 0.5–10 MPa, to provide high gloss and to exhibit beneficial effects of this invention, on varied recording media. In cases when the pressure is less than 0.5 MPa, the surface layer required in this invention cannot be formed. Further, when the pressure exceeds 10 MPa, unevenness of pressurizing results in lowered glossiness at specific areas. Further, depending on environmental conditions during pressurization, the fixing members may be stained with ink components or peeled-off pieces from the recording medium, and also stress to the fixing device may be increased. Therefore, excess pressure is not preferable due to the difficulty of maintaining stable desirable characteristics over a long period.

Further, in the ink-jet image forming method of this invention, the surface roughness (a center line average roughness: Ra) of members contacting the printed surface of the pressurizing members used during the pressurizing process, is preferably 200 nm or less, more preferably Ra is 1–200 nm, and specifically preferably 10–200 nm.

In this invention, it is a desirable characteristic to compress the thermoplastic resin containing layer within a certain range during a treatment process incorporating pressurization as a post-process. With this in mind, not only a favorable surface layer (a protective layer) can be formed, but it is also possible to achieve unexpectedly higher glossiness. An important point is smoothness of the fixing member surface contacting the printing surface of the recording medium during pressurization in a post treatment process. It was proved that when Ra is 200 nm or less, the feeling of high gloss is not impaired. When using fixing members having an Ra of more than 200 nm, high gloss cannot be obtained, nor can scratch resistance, scratch resistance under high humidity and image cracking during long term storage, specifically in conditions of high temperature and high humidity. Thus, Ra of 200 nm or less is not preferable.

A centerline average roughness (Ra) in this invention is defined by JIS surface roughness described in JIS-B-0601. That is to say, a centerline average roughness (Ra) refers to the value determined from the following formula represented in micrometers ($\mu$m), when the measuring length L (2.5 mm in this invention) is extracted from the roughness curve in the center line direction, the center line of the removed portion represents the X axis, longitudinal magnification direction is the Y axis, and the roughness curve is Y=f (X), and as the cut-off value is 0.8 mm.

Formula for Calculation $$Ra = \frac{1}{L}\int_0^L |f(x)|dx$$

As a measuring method for the center line average roughness (Ra), the pressurizing section members are conditioned under an environment of 25° C. and 65% RH for 24 hours, and measurement is performed under the same conditions. The usable measuring equipment includes, for example, a RSTPLUS non-contact three-dimensional micro surface form measuring system, manufactured by WYKO Industrial Services.

Further, in the ink-jet image forming method of this invention, at the same time as or prior to the pressurizing process, a heating treatment is preferably applied along with the pressurizing treatment. Comprising this treatment configuration, compression of the surface layer is easily achieved, and compression over as short a time as possible is preferable, and also formation of a better surface layer (the protective layer) can be realized, which results in higher glossiness.

Further, in the ink-jet image forming method of this invention, a specifically preferable embodiment is to use pigment ink, exhibiting excellent resistance to oxidizing gases. As images are printed using pigment ink, smoothness and glossiness decrease as pigment particles or their aggregates remain on the recording medium surface. Thus, generally, the usage of pigment is not preferable to obtain glossy images, but when a post-process treatment is conducted to compress the thickness of the layer containing a thermoplastic resin relating to this invention in a certain range, any pigment particles remaining on the recording medium surface can be sufficiently blended with the surface layer components. Since the surface becomes smooth, unprecedented glossiness can be realized. Further, it is well known that scratch resistance, scratch resistance at high humidity and image cracking over long period storage, especially in high temperature and high humidity are, extremely deteriorated when pigment ink is used, compared to when dye ink is used. However, in the ink-jet image forming composition of this invention, specifically when pigment ink is used, the effects of this invention are exhibited extremely well.

Accordingly, each of the constituent elements relating to the ink-jet image forming method of this invention will be detailed below.

Initially, the ink-jet recording medium of this invention will be described.

The ink-jet image recording of this invention is characterized by having a surface layer containing a thermoplastic resin, and more specifically, it preferably comprises a non-water permeable support, thereon at least an ink absorbing layer which mainly absorbs ink solvent components, and the surface layer.

Examples of thermoplastic resins usable in the surface layer of this invention include, for example, polycarbonate, polyacrylonitrile, polystyrene, polyacrylic acid, polymethacrylic acid, polyvinyl chloride, polyvinylidene chloride, polyvinyl acetate, polyester, polyamide, polyether, copolymers of these and salts of these. Of these, preferred are styrene-acrylate copolymer, vinyl chloride-vinyl acetate copolymer, vinyl chloride-acrylate copolymer, ethylene-vinyl acetate copolymer, ethylene-acrylate copolymer, and SBR latex. As thermoplastic resins or micro-particles, a plurality of copolymers may be mixed, in which monomer ingredients, particle diameter and the degree of polymerization differ.

In selecting a thermoplastic resin, a great deal of thought should be given to ink receptivity, image glossiness after fixing by heating and pressurizing, image fastness and releasability.

With regard to ink receptivity, in cases when the particle diameter of thermoplastic particles is less than 0.05 $\mu$m, separation of pigment particles and ink solvent in pigment ink takes time leading to a decrease of the ink absorption rate. Further, in cases when the particles exceed 10 $\mu$m, it is not preferred from the viewpoint of adhesiveness of the ink receptive layer to the adjacent solvent absorbing layer during coating onto a support, nor from the viewpoint of film layer strength of the ink-jet recording medium after coating and drying. Therefore, the diameter of thermoplastic resin minute particles is preferably 0.05–10 $\mu$m, more preferably 0.1–5 $\mu$m, and still more preferably 0.1–1 $\mu$m.

Further, as a criterion of thermoplastic resin selection, listed is the glass transition point (Tg). In cases when the Tg is lower than the temperature of coating and drying, for example, the coating and drying temperature during production of the recording medium is higher than the Tg in the first place, resulting in dissolution of voids formed by thermoplastic micro-particles, into which ink permeates.

Furthermore, in cases when the Tg is higher than the temperature at which the support may deform by heat, a fixing operation at high temperature is needed to melt the resin and to form a film layer after ink-jet recording with pigmented ink, resulting in problems of the burden on the apparatus and heat stability of the support. The preferable Tg of thermoplastic minute particles is 50–150° C. Further, minimum film-forming temperature (MFT) range of those is preferably 50–150° C.

From the viewpoint of a minimum effect on the environment, thermoplastic micro-particles are preferably dispersed in a water-based medium, and are specifically preferable to be a water-based latex obtained via emulsion polymerization. In this case, an emulsion polymerized type latex using a nonionic dispersion agent as an emulsifying agent is a preferable embodiment.

Further, thermoplastic micro-particles preferably contain a small amount of residual monomer, preferably being less than 3% of the solid mass of the polymer, more preferably less than 1%, and specifically preferably less than 0.1%.

In the surface layer of this invention, a water soluble binder may be incorporated. A water soluble binder may be used in the range of 1–10% of the thermoplastic micro-particles. Listed as examples of the water soluble binders are polyvinyl alcohol, gelatin, polyethylene oxide, polyvinylpyrrolidone, polyacrylic acid, polyacryl amide, polyurethane, dextran, dextrin, carrageenan (κ, l, λ), agar, pullulan, water soluble polyvinyl butyral, hydroxyethyl cellulose, and carboxymethyl cellulose. These water soluble resins may be used in combination of more than two kinds.

A water soluble binder preferably used in the present invention is polyvinyl alcohol. Polyvinyl alcohols employed in the present invention include common polyvinyl alcohol prepared by hydrolyzing polyvinyl acetate, and in addition, modified polyvinyl alcohols such as terminal cation-modified polyvinyl alcohol and anion-modified polyvinyl alcohol having an anionic group.

The average degree of polymerization of polyvinyl alcohol prepared by hydrolyzing vinyl acetate is preferably 1,000 or more, and is more preferably from 1,500–5,000. Further, the saponification ratio is preferably from 70–100%, and is more preferably from 80–99.5%.

Cation-modified polyvinyl alcohols are, for example, polyvinyl alcohols having a primary to a tertiary amino group, or a quaternary ammonium group in the main chain, or side chain of the foregoing polyvinyl alcohols, as described in JP-A 61-10483, and are obtained upon saponification of a copolymer of ethylenic unsaturated monomers having a cationic group and vinyl acetate.

Listed as ethylenic unsaturated monomers having a cationic group are, for example, trimethyl-(2-acrylamido-2,2-dimethylethyl)ammonium chloride, trimethyl-(3-acrylamido-3,3-dimethylpropyl)ammonium chloride, N-vinylimidazole, N-vinyl-2-methylimidazole, N-(3-dimethylaminopropyl)methacrylamide, hydroxyethyltrimethylammonium chloride, trimethyl-(2-methacryamidopropyl)ammonium chloride, and N-(1,1-dimethyl-3-dimethylaminopropyl)acrylamide.

The content ratio of monomers containing a cation-modified group of the cation-modified polyvinyl alcohol is 0.1–10 mol % to the vinyl acetate, and is preferably 0.2–5 mol %.

Listed as anion-modified polyvinyl alcohols are, for example, polyvinyl alcohols having an anionic group as described in JP-A 1-206088, copolymers of vinyl alcohols and vinyl compounds having a water solubilizing group as described in JP-A 61-237681 and 63-307979, and modified polyvinyl alcohols containing a water solubilizing group, as described in JP-A 7-285265.

Further, listed as nonion-modified polyvinyl alcohols are, for example, polyvinyl alcohol derivatives in which a polyalkylene oxide group is added to a part of polyvinyl alcohol as described in JP-A 7-9758, as well as block copolymers of vinyl compounds having a hydrophobic group and polyvinyl alcohols as described in JP-A 8-25795.

Polyvinyl alcohols, in which the degree of polymerization or modification differ, may be employed in a combination of at least two types.

In the surface layer of this invention, it is preferable to use a filler (an inorganic pigment) together with the above-mentioned thermoplastic resin.

Cited as examples of such fillers, being inorganic pigments, used in this invention may be white inorganic pigments such as light precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, pseudo boehmite, aluminum hydroxide, lithopone, zeolite, and magnesium hydroxide.

The average diameter of the micro-particles may be calculated as follows. The particles themselves, or the cross-section or surface of a surface layer, is observed employing an electron microscope, and each diameter of 1,000 randomly selected particles is determined. The simple average (the numerical average) is obtained as the diameter of the particles based on the determined diameter. Herein, each particle diameter is represented by the diameter of a circle having the same projection area as that of the particle.

Solid micro-particles selected from silica, alumina and alumina hydrate are preferably used as inorganic micro-particles. Silica is more preferably used.

Silica synthesized with a typical wet method, colloidal silica and silica synthesized with a gas phase method may be employed as usable silica in the present invention, and further, specifically preferable is micro-particle silica, colloidal silica and silica synthesized with a gas phase method in the present invention. Of these, micro-particle silica synthesized with a gas phase method is preferable at a high void ratio as can be obtained. Alumina and alumina hydrate may be crystalline or amorphous, and optional shapes of undetermined form, spherical or needle-shaped may also be used.

The particle size of inorganic micro-particles is preferably not more than 100 nm. For example, in case of the foregoing silica synthesized via a gas phase method, the average particle size of primary particles of inorganic pigments dispersed in primary particle state (the particle size in the state of a dispersed solution before coating) is preferably at most 100 nm, more preferably 4–50 nm, and still more preferably 4–20 nm.

As the most preferably used silica synthesized via a gas phase method having an average particle size of primary particles of 4–20 nm, Aerosil produced by Nippon Aerosil Co., Ltd. is commercially available on the market. This micro-particle silica synthesized by a gas phase method is relatively easily dispersed into primary particles in water using Jet-stream Inductor Mixer manufactured by Mitamura Riken Kogyo Co., Ltd., employing suction dispersion.

In this invention, the configuration containing a thermoplastic resin and an inorganic pigment in the surface layer is the most preferable embodiment of this ink-jet recording medium. Specifically, the following points are listed as preferable reasons.

1) The ink absorption rate is high, and image quality deterioration such as beading and color bleeding is rare, and high speed printing potential is provided.
2) The surface strength of images is strong.
3) Fusing rarely occurs when images are stacked.
4) Coating productivity of the surface layer is superior.
5) Writability is provided.

In this case, the solid weight ratio of thermoplastic microparticles to the inorganic pigment in the surface layer may be determined individually depending on factors such as the thermoplastic micro-particles, the inorganic pigment and other additive agents, being not specifically limited, however, in this invention, the ratio (B:F) of thermoplastic resin (B) and filler (F) is preferably 2:8–8:2, more preferably 3:7–7:3, and still more preferably 4:6–6:4.

The surface layer of this invention may contain a cationic water soluble polymer having a quaternary ammonium base group in the molecule, which is generally used at 0.1–10 g per $m^2$ of the ink-jet recording sheet, and preferably used in the range of 0.2–5 g.

The thickness of the surface layer of this invention is preferably 3–15 $\mu$m. As a measuring method for the surface layer thickness, listed as one method is to sever the cross-section of the recording medium through the surface layer precisely in the perpendicular direction, after which it is observed using an optical microscope or scanning electron microscope.

The ink-jet recording medium of the present invention is preferably provided with an ink absorbing layer which absorbs an ink solvent, between a support and the foregoing surface layer.

Generally, an ink absorbing layer is divided mainly into two types, a swelling and a void type. A void type layer is formed by coating a water soluble binder alone or in a combination of water soluble binders, such as gelatin, polyvinyl alcohol, polyvinyl pyrrolidone, and polyethylene oxide, to obtain an ink absorbing layers.

As a void type layer, the micro-particles and water soluble binders are coated after mixing, and a layer exhibiting high gloss is preferred. As micro-particles, alumina or silica is preferably used, and specifically silica having a particle size of at most 0.1 $\mu$m is preferred. As a water soluble binder, gelatin, polyvinyl alcohol, polyvinylpyrrolidone and polyethylene oxide may preferably be used alone or in combination.

To provide aptitude of continuous or high speed printing, a recording medium having a high speed ink absorption rate is more suitable than one having a low rate. From this point of view, the void type is preferably employed.

In the followings, a void type ink absorbing layer (referred to as also a porous layer) will be described in more detail.

A porous layer is formed primarily by weak coagulation of a water soluble binder and inorganic micro-particles. Heretofore, various methods to form voids in film are known, for example: a method to form voids with phase separation of polymers mutually during the drying process, after application of a uniform coating composition containing at least two polymers onto a support; a method to form voids with dissolution of solid micro-particles by soaking ink-jet recording sheet paper in water or appropriate organic solvent after coating and drying of the coating compositions containing solid micro-particles and a hydrophilic or hydrophobic binder, onto a support; a method to form voids in film by foaming of the material during the drying process after application of the coating composition containing a compound having the capability to foam during film formation; a method to form voids in fine porous particles or among micro-particles with coating of the coating compound containing porous solid micro-particles and a hydrophilic binder on a support; a method to form voids among solid micro-particles with application of the coating composition containing fine solid particles and/or micro-particle oil drops having a volume of more than or equivalent to that of the hydrophilic binder and a hydrophilic binder onto a support. Specifically preferred is to form voids containing various inorganic solid micro-particles of an average particle size of at most 100 nm in the porous layer in the present invention.

As inorganic micro-particles used for the above-mentioned purpose, the same micro-particles as inorganic pigment particles may be used in the foregoing surface layer.

Further, as a hydrophilic binder, listed is the same compound as the water soluble binder described in the forgoing surface layer.

The added amount of inorganic micro-particles, employed in the porous layer, varies largely depending on the desired ink absorption capacity, the void ratio of the void layer, the types of fine inorganic particles, and the types of water soluble binders, but is generally from 5–30 g per $m^2$ of the recording sheet, and is preferably from 10–25 g.

The ratio of inorganic micro-particles to a water soluble binder, employed in the porous layer, is generally from 2:1 to 20:1, and is preferably from 3:1 to 10:1.

The ink absorbing layer may contain a cationic water soluble polymer having a quaternary ammonium salt group in the molecule, which is generally employed in the range of 0.1–10 g per $m^2$ of the recording sheet, and is preferably from 0.2–5 g.

The total amount of the voids (meaning void volume) in the porous layer is preferably at least 20 ml per $m^2$ of the recording sheet. In cases when the void volume is less than 20 ml/$m^2$, ink absorbability is adequate with only low ink volume at printing, but problems of lowered image quality or delayed ink drying tend to result in incomplete ink absorption at a high volume of ink.

As another void type ink absorbing layer, other than forming an ink absorbing layer using inorganic micro-particles, the ink absorbing layer can be formed using a coating composition containing a polyurethane resin emulsion in combination with a water soluble epoxy compound and/or an acetoacetylated polyvinyl alcohol, and further an epichlorohydrin polyamide resin. A polyurethane resin emulsion in this case is preferably a polyurethane emulsion having a particle diameter of 3.0 $\mu$m, in which the particles have a polycarbonate chain or a polycarbonate chain and polyester chain. It is more preferable that the polyurethane resin of the polyurethane resin emulsion has a sulfon group in the molecule and also an epichlorohydrin polyamide resin and a water soluble epoxy compound and/or an acetoacetylated vinyl alcohol. Herein, the polyurethane resin is obtained with reaction of polycarbonate polyol, polyol having polycarbonate polyol and polyester polyol, and an aliphatic isocyanate compound.

It is presumed that slight coagulation of cations and anions is formed in the ink solvent absorbing layer using the foregoing polyurethane resin, and based on this, the voids having ink absorbing capability are formed to produce images.

In this invention, the average void ratio of the total ink absorbing layers of the ink-jet recording medium is preferably 40–70%, or the void ratio of the foregoing surface layer is preferably 30–70%.

In the total ink absorbing layer exhibiting ink absorbability or in the surface layer, the void volume to the volume of solids is defined as the void ratio. As one method, it may be determined based on the following formula.

$$\text{The void ratio} = 100 \times [(\text{total dry thickness} - \text{coated solid thickness}) / \text{total dry thickness}]$$

Further, based on the following method, the void ratio of the total ink absorbing layer or of the surface layer. For example, only the total ink absorbing layer or the surface layer is coated onto 100 $\mu$m polyethylene terephthalate, after which the void ratio may be easily determined through the saturated transition amount or the absorbed water amount utilizing Bristow's Measurement.

Now, a support used for the ink-jet recording medium of this invention will be described.

Supports usable in the present invention are common ones for an ink-jet recording sheet, which may be appropriately chosen from paper supports such as standard paper, art paper, coated paper and cast-coated paper; plastic supports; paper supports coated on both sides with polyolefin; and complex supports of pastes of these supports. From the viewpoint of exhibiting effects of this invention, a non-water permeable support is specifically preferable.

As non-water permeable supports usable in this invention, listed are a plastic resin film support or a support in which both sides of a paper base are covered with a plastic resin film. As such plastic resin film supports, listed are, for example, polyester film, polyvinyl chloride film, polypropylene film, cellulose triacetate film, polystyrene film and a film support laminated with these films. These employed plastic resin films may be transparent or translucent.

In this invention, a specifically preferable support is a support which is prepared by covering both sides of a paper base with a plastic resin, and the most preferable support is one which is prepared by covering both sides of a paper base with a polyolefin resin.

The specifically preferable support in this invention will be described below, which is prepared by covering both sides of the paper base with a polyolefin resin.

Paper employed in the supports of this invention is made by employing wood pulp as the main raw material, and if desired, synthetic pulp such as polypropylene or synthetic fiber such as nylon and polyester. Employed as the wood pulp may be any of LBKP, LBSP, NBKP, NBSP, LDP, NDP, LUKP, and NUKP. However, it is preferable that LBKP, NBSP, LBSP, NDP, and LDP comprising short fiber components in a relatively large amount are preferably employed. Incidentally, the ratio of LBSP and/or LDP is preferably 10 to 70 weight %. Preferably employed as the foregoing pulp is chemical pulp (sulfate pulp and sulfite pulp) comprising minimal impurities. Further, also useful is pulp which has been subjected to a bleaching treatment to enhance whiteness.

Suitably incorporated into the paper base may be sizing agents such as higher fatty acids and alkylketene dimers; white pigments such as calcium carbonate, talc, and titanium oxide; paper strength enhancing agents such as starch, polyacrylamide, and polyvinyl alcohol; fluorescent brightening agents; moisture retention agents such as polyethylene glycols; dispersing agents; and softeners such as quaternary ammonium.

The degree of water freeness of pulp employed for paper making is preferably between 200 and 500 ml based on CSF Specification. Further, the sum of the weight % of 24-mesh residue and the weight % of 42-mesh residue regarding the fiber length after beating, specified in JIS P-8207, is preferably 30–70%. Further, the weight % of 4-mesh residue is preferably not more than 20 weight %.

The basis weight of the paper base is preferably 50–250 g, and is specifically preferably 70–200 g. The thickness of the paper base is preferably 50–210 $\mu$m.

During the paper making stage, or alternatively after paper making, the paper base may be subjected to a calendering treatment to result in excellent smoothness. The density of the paper base is generally 0.7–1.2 g/m$^3$ (JIS P-8118). Further, the stiffness of the paper base is preferably 20–200 g under the conditions specified in JIS P-8143.

The surface sizing agent may be coated onto the paper base surface. As a surface sizing agent, the same one as described above, added to the paper base, may be employed.

The pH of the paper base, when determined employing a hot water extraction method specified in JIS P-8113, is preferably 5–9.

Next, polyolefin resin which covers both sides of the paper will now be described. Examples of polyolefin resins used for this purpose include polyethylene, polypropylene, and polyisobutylene. A type of polyolefin such as a copolymer comprising mainly propylene is preferable, and polyethylene is specifically preferable.

The specifically preferable polyethylene will be described below.

Polyethylene covering the surface side and reverse side of a paper base is primarily low density polyethylene (LDPE) and/or high density polyethylene (HDPE), but other LLDPE or polypropylene may also at times be employed.

Specifically, the polyethylene layer of the coating layer side features improved opacity and whiteness by adding rutile or anatase type titanium oxide. The added amount of titanium oxide is generally 1–20% to polyolefin, and preferably 2–15%.

To the polyolefin layer, a heat resistance coloring agent and a fluorescent brightening agent may, if beneficial, be added to adjust the white background.

As examples of such beneficial coloring agents, listed are ultramarine, iron blue, cobalt blue, phthalocyanine blue, manganese blue, cerulean blue, tungsten blue, molybdenum blue, and anthraquinone blue.

As fluorescent brightening agents, listed are, for example, dialkylaminocoumarin, bisdimethylaminostilbene, bismethylaminostilbene, 4-alkoxy-1,8-naphthalenedicarboxylate-N-alkylamide, bisbenzoxazolyl ethylene, and alkylstilbene.

The utilized amount of polyethylene providing on the front or rear surface of the raw paper base is chosen to optimize the thickness of the ink absorbing layer and minimize curling at low humidity as well as high humidity after providing a backing layer. The thickness of the polyethylene layer on the ink absorbing layer side is usually 15–50 $\mu$m, and that of the polyethylene layer on the backing layer side is usually in the range of 10–40 $\mu$m. The ratio of polyethylene on the front and rear sides is optimally chosen to minimize curling, which may vary with the kind and thickness of the ink absorbing layer and the thickness of the raw paper base. Generally the thickness ratio of the front:rear side is respectively 3:1–1:3.

Further, the foregoing paper substrate covered with polyethylene preferably exhibits the following properties:

(1) Tensile strength in the longitudinal direction is preferably 19.6–294 N and that in the lateral direction is 9.8-196 N in terms of strength specified in JIS-P-8113.

(2) Tear strength in the longitudinal direction is preferably 0.20–2.94 N and 0.098–2.45 N in the lateral direction in terms of strength specified in JIS-P-8116.

(3) Compression elastic modulus is preferably 9.8 kN/cm$^2$.

(4) Opacity is preferably more than 80%, and is specifically preferably 85–98%, when measured employing the method specified in JIS-P-8138.

(5) Whiteness at L*, a*, b* are each preferably L*=80–96, a*=−3–+5, and b*=−7–+2, in terms of whiteness specified in JIS-Z-8727.

(6) Clark stiffness: a preferable support exhibits a Clark stiffness of 50–300 cm$^3$/100 in the transfer direction of the recording sheet.

(7) Moisture content of the raw paper base is preferably 4–10% to the core paper.

(8) Surface glossiness (at 75-degree specular glossiness) of the ink absorbing layer side is preferably 10–90%.

In the ink-jet image forming method of this invention, various types of ink well-known in the art such as dye ink, pigment ink, and dispersion ink may be employed. Employment of pigment ink is specifically preferred.

As ink employed for image forming, water based ink compositions, oil based ink compositions, and solid (phase changed) ink compositions may be employed. Specifically, water based ink composition, (for example, water based ink-jet recording liquid containing more than 10 weight % of water based on the total weight of ink), is preferably employed.

As a coloring agent, this invention is characterized by the usage of pigments in view of image storage stability. As a pigment in pigment ink, preferably employed is an organic pigment such as insoluble pigment and a lake pigment, or carbon black.

Insoluble pigments are not specifically limited, but preferred are, for example, azo, azomethine, methane, diphenylmethane, triphenylmethane, quinacridone, anthraquinone, perylene, indigo, quinophthalone, isoinolinone, isoindoline, azine, oxazine, thiazine, dioxazine, thiazole, phthalocyanine and diketopyrrolopyrrole.

As examples of the specific pigments preferably employed, listed are the following:

pigments for magenta or red, for example; C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, and C. I. Pigment Red 222;

Examples of pigments for orange or yellow are:

C. I. Pigment Orange 31, C. I. Pigment Orange 343, C. I. Pigment Yellow 12, C. I. Pigment Yellow 13, C. I. Pigment Yellow 14, C. I. Pigment Yellow 15, C. I. Pigment Yellow 17, C. I. Pigment Yellow 93, C. I. Pigment Yellow 94, and C. I. Pigment Yellow 138;

Examples of pigment for green or cyan are:

C. I. Pigment Blue 15, C. I. Pigment Blue 15:2, C. I. Pigment Blue 15:3, C. I. Pigment Blue 16, C. I. Pigment Blue 60, and C. I. Pigment Green 7.

Together with these pigments, pigment dispersing agents may be employed if appropriate. As usable pigment dispersing agents, listed are, for example, active agents such as higher aliphatic acid salt, alkyl sulfate, alkylester sulfate, alkylsulfonate, sulfosuccinate, naphthalene sulfonate, alkyl phosphate, polyoxyalkylene alkylether phosphates, polyoxyalkylene alkylphenyl ether, polyoxyethylene polyoxypropylene glycol, glycerin ester, sorbitan ester, and polyoxyethylene aliphatic acid amide; or block copolymers, random copolymers and salts thereof, comprising two or more monomers selected from styrene, styrene derivatives, maleic acid, mareic acid derivatives, itaconic acid, itaconic acid derivatives, fumaric acid, and fumaric acid derivatives.

As a dispersion method of pigments, there are no specific limitations, but, for example, various methods such as a ball mill, a sand mill, an attritor, a roll mill, an agitator, a Henschel mixer, a colloid mill, an ultrasonic homogenizer, a pearl mill, a wet type jet-mill, and a paint shaker can be employed.

To eliminate coarse grains in the pigment dispersion of this invention, employing a centrifugal separation apparatus, as well as employing filters are preferable.

The average pigment particle diameter in the pigment ink is selected with consideration of factors such as stability of the ink, image density, glossiness appearance, and resistance to light, and in addition, in the ink-jet image forming method of this invention, it is also preferable to select the particle diameter with respect to improvement of gloss and a sense of quality. In this invention, since the reason for improvement of gloss and sense of quality is not clear, it is assumed to be related to the fact that pigment in images is in a dispersed state in a film layer where thermoplastic micro-particles are fused. To achieve the aim for high speed processing, thermoplastic micro-particles must be fused to form a film layer in a short time, and further, pigments must be sufficiently dispersed in the film layer. In such a case, the surface area of pigments has a significant influence, and therefore the optimum range of average particle diameter must be determined.

The average pigment particle diameter contained in the pigment ink of this invention is preferably 300 nm and less, more preferably 30–200 nm, and still more preferably 30–150 nm.

The preferable water base ink composition as pigment ink is preferably combined with a water soluble organic solvent.

Examples of the water-soluble solvents include alcohols such as methanol, ethanol, propanol, isopropanol, butanol, isobutanol, secondary butanol, tertiary butanol, pentanol, hexanol, cyclohexanol and benzyl alcohol; polyhydric alcohols such as ethylene glycol, diethylene glycol, triethylene glycol, polyethylene glycol, propylene glycol, dipropylene glycol, polypropylene glycol, butylene glycol, hexanediol, pentanediol, glycerine, hexanetriol and thiodiglycol; polyhydric alcohol ethers such as ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monomethyl ether, propylene glycol monobutyl ether, ethylene glycol monomethyl ether acetate, triethylene glycol monomethyl ether, triethylene glycol monoethyl ether, triethylene glycol monobutyl ether, ethylene glycol monophenyl ether, and propylene glycol monophenyl ether; amines such as ethanolamine, diethanol amine, triethanolamine, N-methyldiethanol amine, N-ethyldiethanolamine, morpholine, N-ethylmorpholine, ethylenediamine, diethylenediamine, triethylenetetramine, tetraethylenepentamine, polyethyleneimine, pentamethyldiethylenetriamine and tetramethylpropylenediamine; amides such as formamide, N,N-dimethylformamide and N,N-dimethylacetoamide; heterocyclic compounds such as 2-pyrrolidone, N-methyl-2-pyrrolidone, N-cyclohexyl-2-pyrrolidone, 2-oxazolidone and 1,3-dimethyl-2-imidazolidinone; sulfoxides such as dimethylsuofoxide; sulfones such as sulfolane; urea; acetonitrile and acetone. As a preferable water soluble organic solvent, listed are polyhydric alcohols. It is specifically preferred to use a polyhydric alcohol in combination with a polyhydric alcohol ether.

A water soluble organic solvent may be used alone or in combination with other water soluble organic solvents. The added amount of a water soluble solvent in ink is 5–60 weight % as the total amount, and is preferably 10–35 weight %.

The pigment ink used in this invention preferably contains an acetylene series surface active agent. As such an acetylene series surface active agent, acetylene diol and its ethylene oxide adduct are preferred.

Further, as acetylene diol and its ethylene oxide adduct, Surfynol 82, Surfynol 104, Surfynol 440, Surfynol 465 and Surfynol 485 are preferably employed, all of which are products of Air Products and Chemicals, Inc.

To the ink composition, various commonly known additives such as a viscosity controlling agent, a surface tension controlling agent, a specific resistance controlling agent, a layer forming agent, a mildewcide and a rust inhibiting agent, may be appropriately added with the objective of improving the properties of the ink such as ejection stability, suitability to the print head or cartridge, storage stability, the image stability, as well as other properties.

Specifically, addition of thermoplastic micro-particles to ink is preferable to achieve the effects of this invention. As such thermoplastic micro-particles, the kinds known as thermoplastic resins or micro-particles which can be added to the foregoing surface layer of the recording medium, may be employed. Specifically, it is preferable to apply one which does not cause a viscosity increase nor precipitation when added to the ink. From the viewpoint of stability, the average particle diameter of the thermoplastic particles is preferably 0.5 $\mu$m or less, and is more preferably selected to be in the range of 0.2–2 times compared to the average particle diameter of pigment in ink. Thermoplastic micro-particles to be added preferably fuse or soften in the range of 50–200° C.

The ink composition preferably has a viscosity during ejection of not more than 40 mPa·s, and more preferably not more than 30 mPa·s.

The ink composition preferably has a surface tension during ejection of 20 mN/m or more, and more preferably 30–45 mN/m.

The solid pigment content in the ink is generally selected to be in the range of 0.1–10%, and to obtain almost photographic image quality, so-called gradation inks each of which has varying solids content of pigments are preferably used, and specifically preferable are gradation inks of yellow, magenta, cyan and black. Further, it is also preferable to utilize special color inks such as red, green and blue inks, if necessary, in respect to optimal color reproduction.

To form ink-jet images of this invention, there is no limitation for printers available on the market, as long as they feature a recording medium storage section, a transportation section, an ink cartridge and an ink-jet print head. It is useful, in the case of utilizing ink-jet photographs for commercial purposes, that the printer has features such as series of, at least, a storage section for a roll recording medium, a transportation section, an ink-jet print head, a cutting section and a pressurizing section, and if appropriate, a heating section as well as a recorded print storage section.

A print head may be of any common type such as a piezo type, a thermal type and a continuous type, however preferable is a piezo type with respect to stability when using pigment ink.

Next, post-processing of a pressurizing method and a heating method of the ink-jet image forming method of this invention will be described.

The ink-jet image forming method of this invention comprises the steps of:

(1) ejecting ink as an ink-jet onto the ink-jet recording medium with the foregoing constitution, (2) providing a pressurizing treatment to the ink-jet recording medium using a post-process featuring at least a pressurizing process, and (3) compressing the thickness of the surface layer after the post-process to 50–80% compared to that before printing.

The pressurizing method usable in this invention is not limited as long as the surface layer can be compressed to 50–80%, and preferably utilizes a pressurizing apparatus having a pair of pressure rollers or a pair of pressure belts.

Employed as pressure rollers, can be metallic rollers made of a metal or a roller in which a metal cored bar is covered with an elastic body as a covering layer, and a surface layer (also referred to as a releasing layer) if necessary. The metal cored bar is comprised of, for example, a circular cylinder made of iron, aluminum or stainless steel. Onto the surface of the metal cored bar, a covering layer is provided. As a covering layer, an elastic body having high heat resistance can be employed, and, for example, a HTV (High Temperature Vulcanization) silicone rubber featuring 45° rubber hardness is formed to a desired thickness. Other materials can of course also be employed. On the covering layer, a releasing layer is provided, and used as a covering may, for example, be addition of a RTV (Room Temperature Vulcanization) silicone rubber, a fluorine-contained rubber such as Viton, and a fluorine-contained resin such as PFA (perfluoloa koxyvinyl ether copolymer resin), PTFE (polytetrafluolotaylene), and FEP (ethylene tetrafluoridepropylene hexafluoride copolymer resin).

Further, as a surface layer, other than a silicone rubber, the surface may be covered with a silicone-contained rubber such as Viton, a silicone-contained resin such as PFA (perfluoloalkoxyvinyl ether copolymer resin), PTFE (polytetrafluolothylene), and FEP (ethylene tetrafluoridepropylene hexafluoride copolymer resin).

In this invention, surface roughness of the pressurizing process member contacting the printing surface, is preferably 200 nm or less. This is easily achieved by polishing the foregoing metal roller surface to obtain the desired surface roughness, or by forming controlling accuracy of the covering layer or the surface layer covering the metal cored bar surface.

As pressure (also known as nip pressure) provided by the pressure rollers, there are no limitations as long as the surface layer can be pressurized to 50–80%, and the nip pressure is preferably 0.5–10 MPa, and more preferably 0.8–3.0 MPa.

To achieve the nip pressure prescribed above, for example, springs having specific tension to result in the desired nip pressure may be provided to both sides of the pressure rollers, taking with consideration nip clearance. Springs in this case may be selected from ones having tension of 0.2–10 MPa based on the length of the rollers.

Nip pressure is determined, for example, by dividing the required force added to the pressure rollers by the nip area measured using pressure sensitive paper, or by measurement of density, after pressure measuring paper consisting of pressure sensitive paper is nipped by the pressure rollers. As pressure measuring paper, for example, FPD 301 pressure sensitive paper for ultra super low pressure, produced by FUJI PHOTO FILM CO., LTD.

In this invention, using the foregoing pressurizing means or a combination of pressurizing and heating means to be described later, to compress the surface thickness after the post-process to 50–80% compared to that before printing, namely, a compressibility of 20–50%, is characteristic of this invention.

In this invention, the measurement of the surface thickness before and after the post-process is the same as the measurement of the surface thickness previously described. The thickness is easily determined with a method which severs the recording medium precisely in the perpendicular direction provided with a surface layer before and after the post-process, after which the cross-section portions are photographed using an optical microscope or a scanning electron microscope.

In this invention, it is preferable to apply a heat treatment at the same time or before the pressurizing treatment.

As such a heat treatment method, there is no specific limitation, but it is preferable to use heating rollers or heating belts.

A heat treatment method usable in this invention is one which can provide heat energy to images so that the desired effects of this invention can be sufficiently obtained. Excessively high energy is not preferable due to the resulting deteriorated feel of glossiness by deformation of the support.

Heat may be applied with a heater incorporated into the printer or a heater provided separately. As a heating means, use of heating rollers is preferable due to greater evenness, small space requirement and suitability to continuous processing. Further, a heat fixing device of electrophotography may be converted to the apparatus, and thus it is advantageous from the viewpoint of cost.

For example, with a method of transferring the recording medium between the heating rollers and the pressure rollers, which provide heating elements in the metal cored bar interior of the foregoing pressurizing rollers, a heating treatment and a pressurizing treatment may be affected at the same time, or the recording medium may be nipped to be heated between the two heating rollers. In the roller, a heating element such as a halogen lamp heater, a ceramic heater or a nichrome wire heating element may be incorporated. The roller is preferably made from an excellent heat conductive material, and specifically a metallic roller is preferable. The roller surface is preferably coated with a fluorine-contained resin to prevent staining. In addition, a silicone rubber roller covered with heat resisting silicone may be employed.

The transport rate of the recording medium, when using the heating rollers, is preferably in the range of 1–15 mm/sec. This is also preferable from the high rate processing point of view, as well as from the image quality point of view.

To obtain much better texture and glossiness, it is preferable to apply the foregoing pressurizing treatment at the same time or just after heating.

FIG. 1 indicates an example of an ink-jet recording apparatus usable in this invention, featuring heating-pressurizing rollers which provide a simultaneous heating treatment and a pressurizing treatment. Further, FIG. 2 indicates another example of an ink-jet recording apparatus usable in this invention, having heating-pressurizing belts which also provide a heating treatment and a pressurizing treatment.

EXAMPLES

The present invention will now be exemplified referring to examples, but this invention in not limited to these examples.

Preparation of Recording Media

Preparation of Recording Medium 1

Preparation of Silica Dispersion Solution

Using a JET STREAM INDUCTOR MIXER TDS manufactured by Mitamura Riken Kogyo Co., Ltd., 125 Kg of gas phase method silica was dispersed by suction into 620 L of water adjusted to pH of 2.5 with nitric acid at room temperature, after which the total amount was brought to 694 L with water.

Next, to 18 L of aqueous solution (at a pH of 2.3) containing 1.14 Kg of cationic polymer P-1, 2.2 L of ethanol and 1.5 L of n-propanol, 69.4 L of the foregoing silica dispersion solution was added while stirring, after which 7.0 L of aqueous solution containing 260 g of boric acid and 230 g of borax were added, and then 1 g of anti-foaming agent SN 381 produced by San Nopco, Ltd. was added. The mixture solution was dispersed using a high pressure homogenizer manufactured by Sanwa Industries Co., Ltd., after which the total amount was brought to 97 L with water, to obtain the Silica Dispersion Solution.

Chemical Formula

P-1

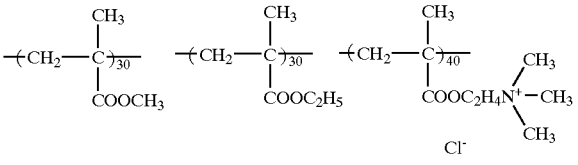

Mn = 13000

Preparation of Underlayer Coating Composition 1

To 600 ml of the foregoing silica dispersion solution, the following additives were sequentially mixed while stirring at 40° C. to prepare Underlayer Coating Composition 1.

| | |
|---|---|
| Polyvinyl alcohol (PVA 203, produced by Kuraray Co., Ltd.), a 10% aqueous solution | 6 ml |
| Polyvinyl alcohol (PVA 235, produced by Kuraray Co., Ltd.), a 7% aqueous solution | 185 ml |
| Saponin (being a 50% aqueous solution) proper quantity | 1,000 ml |
| Water to make | |

Preparation of Coating Composition 2

To a proper quantity of water, the following additives were mixed in the stated order at 40° C. while stirring to prepare Surface Layer Coating Composition 1.

| | |
|---|---|
| Thermoplastic resin (styrene-acryl latex having a Tg of 73° C., at an average particle diameter of 0.9 μm, solid content of 40%) | 166 g |
| Polyvinyl alcohol (PVA 235, produced by Kuraray Co., Ltd.), a 7% aqueous solution | 18 ml |
| Anti-foaming agent SN 381 (produced by San Nopco, Ltd.) | 6.2 ml |
| Saponin (being a 50% aqueous solution) proper quantity | 1,000 ml |
| Water to make | |

After each of the foregoing additives was added, water was added as appropriate so that the viscosity was brought to 45 mPa·s at 40° C. to obtain Surface Layer Coating Composition 1.

Preparation of Recording Medium 1

Onto the base paper, both sides of which were covered with polyethylene (thickness of 220 μm, containing 13 weight % of anatase type titanium oxide to polyethylene in the ink absorbing layer side), foregoing Underlayer Coating Composition 1 was coated using a slide hopper as the first layer from the support, after which foregoing Surface Layer Coating Composition 1 was coated thereon using a slide hopper for the second layer, and dried to obtain Recording Medium 1. Meanwhile, the coating compositions were coated after heating to 40° C., and right after coating, cooled for 20 sec. in a cooling zone maintained at 0° C., and then, dried sequentially for 60 sec. with 25° C. air (15% RH), for 60 sec. with 45° C. air (25% RH), and for 60 sec. with 50° C. air (25% RH), after which it was conditioned for 2 min. with 20–25° C. air and 40–60% RH to finish up. The coating amounts were adjusted to obtain a dry thickness of the underlayer and the surface layer of 30 μm and 10 μm respectively. This Recording Medium 1 was processed into a roll of 127 mm width by 100 m length.

Measurement of Void Ratio of Recording Medium 1

The void ratio of Recording Medium 1 as prepared above was determined employing the following formula. The void ratios of only Surface Layer alone and Underlayer were determined with measurement of each void ratio of the Surface Layer and the Underlayer, after coating each Coating Compositions separately onto polyethylene film under the identical conditions as above.

$$\text{Void ratio}=100\times[(\text{total dry thickness}-\text{coated solid thickness})/\text{total dry thickness}]\ (\%)$$

As resulting measurements, the average void ratio of the total layers of Recording Medium 1 was 54%, that of Underlayer was 62% and that of Surface Layer was 28%.

Preparation of Recording Medium 2

Recording Medium 2 was prepared in the same manner as foregoing Recording Medium 1, except that Surface Layer Coating Composition 1 was replaced with Surface Layer Coating Composition 2 described below, at a dry thickness of 7 μm for the Surface Layer, and the coating compositions for the underlayer and the surface layer simultaneously coated with a multi-layer coating method.

Preparation of Surface Layer Coating Composition 2

Underlayer Coating Composition 1 used for preparation of Recording Medium 1 was stirred at 40° C., thereto a thermoplastic resin (styrene-acryl series latex, having a Tg of 73° C., at an average particle diameter of 0.2 μm, and a solid content of 40%) was added so that the solid ratio of thermoplastic micro-particles/a filler (silica) was 80/20, and further, water was appropriately added to bring the viscosity to 45 mPa·s at 40° C. to obtain Surface Layer Coating Composition 2.

Measurement of Void Ratio of Recording Medium 2

The resulting measurement of each layer's void ratio was obtained in the same manner as the foregoing method, so that the average void ratio of the total layers of Recording Medium 2 was 59%, that of the Underlayer was 62% and that of the Surface Layer was 45%.

Preparation of Recording Medium 3

Recording Medium 3 was prepared in the same manner as foregoing Recording Medium 2, except that the solid ratio of thermoplastic micro-particles/the filler (silica) was changed to 50/50. The resulting measurement of the void ratio of Recording Medium 3 was obtained in the same manner as the foregoing method, so that the average void ratio of the total layers of Recording Medium 3 was 61%, that of the Underlayer was 62% and that of the Surface Layer was 59%.

Preparation of Recording Medium 4

Recording Medium 4 was prepared in the same manner as foregoing Recording Medium 2, except that the solid ratio of thermoplastic micro-particles/a filler (silica) was changed to 20/80. The resulting measurement of the void ratio of Recording Medium 4 was obtained in the same manner as the foregoing method, so that the average void ratio of the total layers of Recording Medium 4 was 62%, that of the Underlayer was 62% and that of the Surface Layer was 61%.

Preparation of Recording Medium 5

Recording Medium 5 was prepared in the same manner as foregoing Recording Medium 2, except that the solid ratio of thermoplastic micro-particles/a filler (silica) was changed to 90/10. The resulting measurement of the void ratio of Recording Medium 5 was obtained in the same manner as the foregoing method, so that the average void ratio of the total layers of Recording Medium 5 was 57%, that of the Underlayer was 62% and that of the Surface Layer was 35%.

Preparation of Recording Medium 6

Recording Medium 6 was prepared in the same manner as foregoing Medium 2, except that the solid ratio of thermoplastic micro-particles/a filler (silica) was changed to 10/90. The resulting measurement of the void ratio of Recording Medium 6 was obtained in the same manner as the foregoing method, so that the average void ratio of the total layers of Recording Medium 6 was 62%, that of the Underlayer was 62% and that of the Surface Layer was 62%.

Preparation of Recording Medium 7

Recording Medium 7 was prepared so that the average void ratio of the total layers was 72%, that of the Underlayer was 72% and that of the Surface Layer was 71% by changing the added amount of polyvinyl alcohol in the underlayer coating composition and also the surface layer coating composition.

Preparation of Recording Medium 8

Recording Medium 8 was prepared in the same manner as foregoing Medium 3, except that the thermoplastic resin was changed to an acrylic latex having a Tg of 43° C. and an average particle diameter of 0.12 μm, and a solid content of 40%.

Preparation of Ink

Preparation of Dye Ink Set

A Dye Ink Set consisted of each color of yellow (Y), magenta (M), cyan (C) and black (Bk) was prepared, and the composition of each is shown below.

After sufficient stirring and filtration, the prepared inks were employed using 0.8 μm filters (DISMIC-25CS, produced by Toyo Roshi Kaisha Ltd.).

| Y Ink | |
|---|---|
| Acid Yellow 42 | 5 weight % |
| Proxel GXL (D) (a 20% aqueous solution, produced by Zeneca AG Products, Inc.) | 0.2 weight % |
| Surface active agent (SURFYNOL 465, produced by Nissin Chemical Industry Co., Ltd.) | 0.05 weight % |
| Ethylene glycol | 12 weight % |
| Diethylene glycol | 13 weight % |
| Ion exchanged water for a total weight of 100 g | |
| Surface tension was 33 mN/m. | |
| M Ink | |
| Acid Red 249 | 3 weight % |
| Proxel GXL (D) (a 20% aqueous solution, produced by Zeneca AG Products, Inc.) | 0.2 weight % |
| Surface active agent (SURFYNOL 465, produced by Nissin Chemical Industry Co., Ltd.) | 0.05 weight % |
| Ethylene glycol | 12 weight % |
| Diethylene glycol | 13 weight % |
| Ion exchanged water for a total weight of 100 g | |
| Surface tension was 32 mN/m. | |
| C Ink | |
| Acid Blue 249 | 3.8 weight % |
| Proxel GXL (D) (a 20% aqueous solution, produced by Zeneca AG Products, Inc.) | 0.2 weight % |
| Surface active agent (SURFYNOL 465, produced by Nissin Chemical Industry Co., Ltd.) | 0.05 weight % |
| Ethylene glycol | 12 weight % |
| Diethylene glycol | 13 weight % |
| Ion exchanged water for a total weight of 100 g | |
| Surface tension was 34 mN/m. | |
| Bk Ink | |
| BASF Acid Black 7 | 19 weight % |
| Proxel GXL (D) (a 20% aqueous solution, produced by Zeneca AG Products, Inc.) | 0.2 weight % |
| Surface active agent (SURFYNOL 465, produced by Nissin Chemical Industry Co., Ltd.) | 0.05 weight % |
| Ethylene glycol | 12 weight % |
| Diethylene glycol | 13 weight % |
| Ion exchanged water for a total weight of 100 g | |
| Surface tension was 43 mN/m. | |

Preparation of Pigment Ink Set

Preparation of Pigment Dispersion Solution

| Preparation of Yellow Pigment Dispersing Element 1 | |
|---|---|
| C. I. Pigment Yellow 74 | 20 weight % |
| Styrene-acrylic acid copolymer (having molecular weight of 10,000 and an acid value of 120) | 12 weight % |
| Diethylene glycol | 15 weight % |
| Ion exchanged water | 53 weight % |

All of the foregoing additives were mixed with each other and dispersed using a horizontal bead mill filled with 0.3 mmϕ zirconia beads at a volume ratio of 60% (SYSTEM ZETA-MINI, manufactured by Ashizawa Finetech Co., Ltd.) to obtain Yellow Pigment Dispersing Element 1. The average particle diameter of the obtained yellow pigment was 112 nm.

| Preparation of Magenta Pigment Dispersing Element 1 | |
|---|---|
| C. I. Pigment Red 122 | 25 weight % |
| JONCRYL 61 (acryl-styrene type resin, produced by JOHNSON POLYMER CORPORATION) as a solid content | 18 weight % |
| Diethylene glycol | 15 weight % |
| Ion exchanged water | 42 weight % |

All additives described above were mixed and dispersed using a horizontal bead mill filled with 0.3 mmϕ zirconia beads at a volume ratio of 60% (System Zeta-mini, manufactured by Ashizawa Finetech Co., Ltd.) to obtain Magenta Pigment Dispersing Element 1. The average particle diameter of the obtained magenta pigment was 105 nm.

| Preparation of Cyan Pigment Dispersing Element 1 | |
|---|---|
| C. I. Pigment Blue 15:3 | 25 weight % |
| JONCRYL 61 (acryl-styrene type resin, produced by JOHNSON POLYMER CORPORATION) as a solid content | 15 weight % |

-continued

| Preparation of Cyan Pigment Dispersing Element 1 | |
|---|---|
| Glycerin | 10 weight % |
| Ion exchanged water | 50 weight % |

All additives described above were mixed and dispersed using a horizontal bead mill filled with 0.3 mmϕ zirconia beads at a volume ratio of 60% (SYSTEM ZETA-MINI, manufactured by Ashizawa Finetech Co., Ltd.) to obtain Cyan Pigment Dispersing Element 1. The average particle diameter of the obtained cyan pigment was 87 nm.

| Preparation of Black Pigment Dispersing Element 1 | |
|---|---|
| Carbon black | 20 weight % |
| Styrene-acrylic acid copolymer (having a molecular weight of 7,000 and an acid value of 150) | 10 weight % |
| Glycerin | 10 weight % |
| Ion exchanged water | 60 weight % |

All additives described above were mixed and dispersed using a horizontal bead mill filled with 0.3 mmϕ zirconia beads at a volume ratio of 60% (SYSTEM ZETA-MINI, manufactured by Ashizawa Finetech Co., Ltd.) to obtain Black Pigment Dispersing Element 1. The average particle diameter of the obtained black pigment was 75 nm.

| Preparation of Concentrated Yellow Ink 1 | |
|---|---|
| Yellow Dispersing Element 1 | 15 weight % |
| Ethylene glycol | 20 weight % |
| Diethylene glycol | 10 weight % |
| Surface active agent (SURFYNOL 465, produced by Nissin Chemical Industry) | 0.1 weight % |
| Ion exchanged water | 54.9 weight % |

All components above were mixed and stirred, after which the mixture was filtered using a 1 μm filter to obtain Concentrated Yellow Ink 1 of the water base pigment ink of this invention. The average particle diameter of the pigment in this ink was 120 nm, and surface tension γ of this ink was 36 mN/m.

| Preparation of Pale Yellow Ink 1 | |
|---|---|
| Yellow Dispersing Element 1 | 3 weight % |
| Ethylene glycol | 25 weight % |
| Diethylene glycol | 10 weight % |
| Surface active agent (SURFYNOL 465, produced by Nissin Chemical Industry) | 0.1 weight % |
| Ion exchanged water | 61.9 weight % |

All components above were mixed and stirred, after which the mixture was filtered using a 1 μm filter to obtain Pale Yellow Ink 1 of the water base pigment ink of this invention. The average particle diameter of the pigment in this ink was 118 nm, and surface tension γ of this ink was 37 mN/m.

| Preparation of Concentrated Magenta Ink 1 | |
|---|---|
| Magenta Dispersing Element 1 | 15 weight % |
| Ethylene glycol | 20 weight % |
| Diethylene glycol | 10 weight % |
| Surface active agent (SURFYNOL 465, produced by Nissin Chemical Industry) | 0.1 weight % |
| Ion exchanged water | 54.9 weight % |

All components above were mixed and stirred, after which the mixture was filtered using a 1 μm filter to obtain Concentrated Magenta Ink 1 of the water base pigment ink of this invention. The average particle diameter of the pigment in this ink was 113 nm, while surface tension γ of this ink was 35 mN/m.

| Preparation of Pale Magenta Ink 1 | |
|---|---|
| Magenta Dispersing Element 1 | 3 weight % |
| Ethylene glycol | 25 weight % |
| Diethylene glycol | 10 weight % |
| Surface active agent (SURFYNOL 465, produced by Nissin Chemical Industry) | 0.1 weight % |
| Ion exchanged water | 61.9 weight % |

All components above were mixed and stirred, after which the mixture was filtered using a 1 μm filter to obtain Pale Magenta Ink 1 of the water base pigment ink of this invention. The average particle diameter of the pigment in this ink was 110 nm, while surface tension γ of this ink was 37 mN/m.

| Preparation of Concentrated Cyan Ink 1 | |
|---|---|
| Cyan Dispersing Element 1 | 10 weight % |
| Ethylene glycol | 20 weight % |
| Diethylene glycol | 10 weight % |
| Surface active agent (SURFYNOL 465, produced by Nissin Chemical Industry) | 0.1 weight % |
| Ion exchanged water | 59.9 weight % |

All components above were mixed and stirred, after which the mixture was filtered using a 1 μm filter to obtain Concentrated Cyan Ink 1 of the water base pigment ink of this invention. The average particle diameter of the pigment in this ink was 95 nm, while surface tension γ of this ink was 36 mN/m.

| Preparation of Pale Cyan Ink 1 | |
|---|---|
| Cyan Dispersing Element 1 | 2 weight % |
| Ethylene glycol | 25 weight % |
| Diethylene glycol | 10 weight % |
| Surface active agent (SURFYNOL 465, produced by Nissin Chemical Industry) | 0.2 weight % |
| Ion exchanged water | 62.8 weight % |

All components above were mixed and stirred, after which the mixture was filtered using a 1 μm filter to obtain Pale Cyan Ink 1 of the water base pigment ink of this invention. The average particle diameter of the pigment in this ink was 92 nm, while surface tension γ of this ink was 33 mN/m.

| Preparation of Concentrated Black Ink 1 | |
|---|---|
| Black Dispersing Element 1 | 10 weight % |
| Ethylene glycol | 20 weight % |
| Diethylene glycol | 10 weight % |
| Surface active agent (SURFYNOL 465, produced by Nissin Chemical Industry) | 0.1 weight % |
| Ion exchanged water | 59.9 weight % |

All components above were mixed and stirred, after which the mixture was filtered using a 1 μm filter to obtain Concentrated Black Ink 1 of the water base pigment ink of this invention. The average particle diameter of the pigment in this ink was 85 nm, while surface tension γ of this ink was 35 mN/m.

| Preparation of Pale Black Ink 1 | |
|---|---|
| Black Dispersing Element 1 | 2 weight % |
| Ethylene glycol | 25 weight % |
| Diethylene glycol | 10 weight % |
| Surface active agent (SURFYNOL 465, produced by Nissin Chemical Industry) | 0.1 weight % |
| Ion exchanged water | 62.9 weight % |

All components above were mixed and stirred, after which the mixture was filtered using a 1 μm filter to obtain Pale Black Ink 1 of the water base pigment ink of this invention. The average particle diameter of the pigment in this ink was 89 nm, while surface tension γ of this ink was 36 mN/m.

Formation of Ink-Jet Images

For the ink-jet printer having heat and pressure roller pairs described in FIG. 1, applying a pressurizing treatment and a heating treatment at the same time, Dye Ink Set or Pigment Ink Set were provided, each of the Recording Mediums prepared as above were fed in sheet form. Outputted were solid images of yellow, magenta, cyan and black, and a plaid test chart consisted of lengthwise and breadthwise 1 cm belts of each Y, M, C, B, G, R, Bk. Thereafter, using a heating and pressurizing fixing device provided in the printing apparatus, a 110° C. surface temperature heating and pressurizing process was performed by the fixing device.

Regarding the above, the output conditions (output speed) were one of the following two conditions.

Output condition 1: 1.5 $m^2$/hr. output

Output condition 2: 3.0 $m^2$/hr. output

In addition, of the paired heating and pressurizing rollers, employed were metal rollers having a covering layer, which were provided on the side contacting the surface of the recording medium, which incorporated a halogen heater having a surface roughness of 100 nm. Using the above image forming method, Images 1–21 were prepared combining the kinds of the recording media and nip pressure as described in Table 1.

Measurement of the Degree of Compression

Of the unprinted areas of the recording media after formation of foregoing Images 1–21, the thickness of the surface layers was measured before and after a heating and pressurizing process using a scanning type atomic microscope using the foregoing method. The degree of compression was determined using the following formula, the obtained results of which are shown in Table 1.

Degree of compression=surface thickness after a heating and pressurizing treatment/surface thickness before a heating and pressurizing treatment×100 (%)

TABLE 1

| | | | Void Ratio (%) | | | | Heating and Pressurizing Treatment Conditions | | Surface Layer Thickness | | | |
|---|---|---|---|---|---|---|---|---|---|---|---|---|
| Image No. | Recording Medium | TMP/F of Surface Layer | Average of Total Layers | Underlayer | Surface Layer | Ink Type | Heating Temperature (° C.) | Nip Pressure (MPa) | Before Pressurizing | After Pressurizing | Degree of Compression (%) | Remarks |
| 1 | 1 | 100/0 | 54 | 62 | 28 | Dye | 110 | 0.3 | 10 | 9.5 | 95 | Comp. |
| 2 | 1 | 100/0 | 54 | 62 | 28 | Dye | 110 | 0.6 | 10 | 8.0 | 80 | Inv. |
| 3 | 1 | 100/0 | 54 | 62 | 28 | Dye | 110 | 1.0 | 10 | 5.0 | 50 | Inv. |
| 4 | 2 | 80/20 | 59 | 62 | 45 | Dye | 110 | 1.0 | 7 | 4.5 | 64 | Inv. |
| 5 | 3 | 50/50 | 61 | 62 | 59 | Dye | 110 | 1.0 | 7 | 5.0 | 71 | Inv. |
| 6 | 4 | 20/80 | 62 | 62 | 61 | Dye | 110 | 1.0 | 7 | 5.3 | 76 | Inv. |
| 7 | 2 | 80/20 | 59 | 62 | 45 | Dye | 110 | 0.3 | 7 | 6.5 | 93 | Comp. |
| 8 | 1 | 100/0 | 54 | 62 | 28 | Pigment | 110 | 0.3 | 10 | 9.5 | 95 | Comp. |
| 9 | 1 | 100/0 | 54 | 62 | 28 | Pigment | 110 | 0.6 | 10 | 8.0 | 80 | Inv. |
| 10 | 1 | 100/0 | 54 | 62 | 28 | Pigment | 110 | 1.0 | 10 | 5.0 | 50 | Inv. |
| 11 | 1 | 100/0 | 54 | 62 | 28 | Pigment | 110 | 1.0 | 7 | 3.5 | 50 | Inv. |
| 12 | 5 | 90/10 | 57 | 62 | 35 | Pigment | 110 | 1.0 | 7 | 4.0 | 57 | Inv. |
| 13 | 2 | 80/20 | 59 | 62 | 45 | Pigment | 110 | 1.0 | 7 | 4.5 | 64 | Inv. |
| 14 | 3 | 50/50 | 61 | 62 | 59 | Pigment | 110 | 1.0 | 7 | 5.0 | 71 | Inv. |
| 15 | 4 | 20/80 | 62 | 62 | 61 | Pigment | 110 | 1.0 | 7 | 5.3 | 76 | Inv. |
| 16 | 6 | 10/90 | 62 | 62 | 62 | Pigment | 110 | 1.0 | 7 | 5.5 | 79 | Inv. |
| 17 | 2 | 80/20 | 59 | 62 | 45 | Pigment | 110 | 1.0 | 7 | 6.5 | 93 | Comp. |
| 19 | 8 | 50/50 | 61 | 62 | 59 | Pigment | 25 | 1.3 | 7 | 5.5 | 79 | Inv. |
| 20 | 1 | 100/0 | 54 | 62 | 28 | Pigment | 110 | 0.45 | 10 | 8.5 | 85 | Comp. |
| 21 | 2 | 80/20 | 59 | 62 | 45 | Pigment | 110 | 2.0 | 7 | 3.1 | 44 | Comp. |

Comp.; Comparative Example
Inv.; This Invention
TMP/F; weight ratio of thermoplastic micro-particles/filler Characteristics Evaluation of Formed Images The images formed employing the foregoing methods were subjected to characteristic evaluation utilizing the following methods.

Evaluation of Scratch Resistance

Of the images formed above, scratch resistance of each solid black image was measured using a scratch resistance tester HEIDON-18 (manufactured by Heidon Co., Ltd.) with a 0.1 mmR sapphire stylus under atmospheric conditions of 25° C. and 50% RH. Measurement was conducted as a scratch test, changing the load from 1–10 g in a range of 10 cm for 3 tests. Defining the minimum load to cause a scratch mark on the images as the scratch resistance, the measured value was termed the value of scratch resistance.

Evaluation of Scratch Resistance Under High Humidity

Solid magenta image areas of images formed as above were rubbed 10 times with a cotton-tipped swab moistened with water, and then images after rubbing were evaluated using the following criteria.

3: After rubbing, no image change was noted.

2: A slight density decrease was observed.

1: At almost all rubbed portions, image peeling was observed.

Evaluation of Scratch Resistance Under High Humidity

Each of the images formed above was allowed to stand under ambient conditions of 40° C. and 80% RH, and transferred daily to ambient conditions of 25° C. and 50% RH, observing solid image surfaces of yellow, magenta, cyan and black to note the number of days until cracking occurred. The average number of days of each color was the measure of Scratch Resistance under High Humidity.

Evaluation of Glossiness 1: Measurement of C Value

According to solid black image areas outputted using pigment inks, C values were measured using an image clarity meter manufactured by Suga Test Instruments Co., Ltd. (ICM-IDP).

Evaluation of Glossiness 2: Evaluation of Bronzing Resistance

For each image outputted by using pigment ink, bronzing was evaluated using the following methods, which was a pigment-specific phenomenon and one of the factors deteriorating image quality. Evaluation of bronzing was conducted by observing images under fluorescent light from angles of (directly overhead was 90° and horizontally was 0°) 80°, 60°, 45° and 30°, based on the following criteria.

3: In observation from any of the angles, no bronzing (metallic gloss) was observed.

2: In observation from any of the angles, slight bronzing was observed in a few of the images.

1: In observation from almost all angles, bronzing was observed.

The results obtained above are shown in Table 2.

TABLE 2

| Image No. | Recording Medium | Scratch Resistance | Scratch Resistance at High Humidity | Cracking Resistance at High Humidity | Evaluation of Glossiness: C value | Evaluation of Glossiness: Bronzing Resistance | Remarks |
|---|---|---|---|---|---|---|---|
| 1 | 1 | 2 | 1 | 1 | — | — | Comp. |
| 2 | 1 | 3 | 3 | 3 | — | — | Inv. |
| 3 | 1 | 4 | 3 | 3 | — | — | Inv. |
| 4 | 2 | 4 | 2 | 4 | — | — | Inv. |
| 5 | 3 | 5 | 3 | 5 | — | — | Inv. |
| 6 | 4 | 5 | 3 | 5 | — | — | Inv. |
| 7 | 2 | 2 | 1 | 1 | — | — | Comp. |
| 8 | 1 | 1 | 1 | 1 | 70 | 1 | Comp. |
| 9 | 1 | 2 | 2 | 2 | 80 | 3 | Inv. |
| 10 | 1 | 3 | 2 | 2 | 82 | 3 | Inv. |
| 11 | 1 | 3 | 2 | 2 | 82 | 3 | Inv. |
| 12 | 5 | 3 | 2 | 3 | 85 | 3 | Inv. |
| 13 | 2 | 4 | 2 | 4 | 89 | 3 | Inv. |
| 14 | 3 | 5 | 3 | 5 | 90 | 3 | Inv. |
| 15 | 4 | 5 | 3 | 5 | 86 | 2 | Inv. |
| 16 | 6 | 5 | 3 | 5 | 80 | 2 | Inv. |
| 17 | 2 | 1 | 1 | 1 | 64 | 3 | Comp. |
| 18 | 7 | 3 | 2 | 2 | 76 | 2 | Inv. |
| 19 | 8 | 3 | 2 | 3 | 80 | 2 | Inv. |
| 20 | 1 | 1 | 1 | 2 | 71 | 1 | Comp. |
| 21 | 2 | 2 | 2 | 1 | 58 | 2 | Comp. |

Comp.; Comparative Example
Inv.; This Invention

As is apparent from Table 2, it is proved that the present invention, providing a heating and pressurizing process after image printing, and a surface layer thickness after a heating and pressurizing process of 50–80% compared to that of before printing, is superior in Scratch Resistance, Scratch Resistance at High Humidity, Cracking Resistance at High Humidity, Glossiness and Bronzing Resistance, compared to the comparative examples. Of these, it is proved that extremely desirable effects were obtained in samples in which B:F of the surface layer is set in the range of 2:8–8:2, the average void ratio of the total ink absorbing layer is set to 40–70% and the surface layer void ratio is set to 30–70%, or images are formed using pigment ink.

Further, in addition to the above evaluation, beading and color bleeding as image quality evaluation and releasability between the recording medium surface and the pressurizing apparatus (the heat and pressure roller) during the pressurizing process were evaluated under the foregoing two output conditions.

Under Output Condition 1, on none of the outputted images of this invention, were beading and color bleeding observed, resulting in high quality images. Further, under Output Condition 2 of the high rate output conditions, on the images using Recording Medium 1, beading and color bleeding were observed in numerous places. The image quality was unacceptable as viable photographic images. With the method of using Recording Medium 1, image defects such as partial image peeling was noted, and stains were also observed on the pressurizing device. On the contrary, the outputted images using the recording media containing silica in the surface layers of this invention did not at all suffer from beading and color bleeding, or only to a very slight degree, resulting in highly viable image quality. Specifically, on the examples using a thermoplastic resin: a filler ratio in the range of 2:8–8:2, beading and color bleeding were rarely observed, while the image quality was good. Further, on those images, defects such as layer peeling were not noted at all.

Further, prior to printing onto the recording medium under atmospheric conditions of 25° C. and 50% RH, the recording medium was transported through a printer without printing to evaluate cracking of the unprinted recording medium, which showed no cracking. A similar evaluation was conducted under atmospheric conditions of 15° C. and 20% RH, showing that only on Recording Medium 7, having a high void ratio, 1–3 thin crack lines were generated per 10 cm in the transport direction. As a result, it is proved that Recording Medium 7 exhibited image defects, when transported under low temperature and low humidity.

Based on the present invention, it is possible to provide an ink-jet image forming method excellent in scratch resistance of printed images, image cracking resistance when stored under high humidity, scratch resistance under high humidity, excellent glossiness and bronzing resistance.

What is claimed is:

1. A method of forming an ink-jet image, comprising the steps of:

ejecting droplets of an ink onto an ink-jet recording media which includes a support having thereon an outermost layer containing a thermoplastic resin; and then applying pressure onto the outermost layer with a pressing apparatus so that a thickness of the outermost layer after applying pressure is 50 to 80% of the thickness of the outermost layer before applying pressure;

wherein the outermost layer is a porous ink receiving layer having a mean void ratio of 30 to 70% based on the total volume of the outermost layer.

2. The method of forming an ink-jet image of claim 1, wherein the outermost layer further contains a filler.

3. The method of forming an ink-jet image of claim 2, wherein a weight ratio of the thermoplastic resin to the filler is between 2:8 and 8:2.

4. The method of forming an ink-jet image of claim 1, wherein the ink-jet recording media further contains an ink absorbing layer between the outermost layer and the support, and a mean void ratio in a combined section of the ink absorbing layer and the outermost layer is from 40 to 70% based on the total volume of the combined section.

5. The method of forming an ink-jet image of claim 1, wherein the outermost layer has a thickness of 3 to 15 $\mu$m.

6. The method of forming an ink-jet image of claim 1, wherein the support is non-water absorptive.

7. The method of forming an ink-jet image of claim 1, wherein the applied pressure is 0.5 to 10 MPa.

8. The method of forming an ink-jet image of claim 1, wherein the pressing apparatus has a pressing member which contacts the outermost layer of the ink-jet recording media, and the pressing member has a surface roughness of not more than 200 nm.

9. The method of forming an ink-jet image of claim 1, further comprising the step of:

applying heat onto the ink-jet recording media prior to the pressure applying step or during the pressure applying step.

10. The method of forming an ink-jet image of claim 1, wherein the ink contains a pigment.

11. The method of forming an ink-jet image of claim 1, wherein the outermost layer is a porous ink receiving layer having a mean void ratio of 50 to 70% based on the total volume of the outermost layer.

* * * * *